US005079590A

United States Patent [19]

DeCecca

[11] Patent Number: 5,079,590

[45] Date of Patent: Jan. 7, 1992

[54] SEALING MECHANISM FOR TONER HANDLING APPARATUS

[75] Inventor: Michael L. DeCecca, Fairport, N.Y.

[73] Assignee: Eastman Kodak Company, Rochester, N.Y.

[21] Appl. No.: 582,459

[22] Filed: Sep. 14, 1990

[51] Int. Cl.[5] ..... G03G 15/06

[52] U.S. Cl. ..... 355/260; 355/202; 277/211; 285/295

[58] Field of Search ..... 355/260, 215, 202, 245; 277/DIG. 6, 209, 211; 285/295; 405/145

[56] References Cited

U.S. PATENT DOCUMENTS

| | | | |
|---|---|---|---|
| 3,836,183 | 9/1974 | Battle | 277/211 X |
| 4,062,385 | 12/1977 | Katusha et al. | 141/89 |
| 4,065,335 | 12/1977 | Pollack | 156/69 |
| 4,237,943 | 12/1980 | Ermel et al. | 141/284 |
| 4,614,286 | 9/1986 | Yamaguchi et al. | 222/505 |
| 4,732,277 | 3/1988 | Smith | 206/633 |
| 4,797,704 | 1/1989 | Williams et al. | 355/260 |
| 4,862,210 | 8/1989 | Woolley | 355/260 X |
| 4,884,723 | 12/1989 | Dugge | 277/166 X |
| 4,913,448 | 4/1990 | Bhagwat et al. | 355/260 X |
| 4,931,838 | 6/1990 | Ban et al. | 355/260 |
| 4,937,628 | 6/1990 | Cipolla et al. | 355/260 |

FOREIGN PATENT DOCUMENTS

| | | | |
|---|---|---|---|
| 0330225 | 8/1989 | European Pat. Off. | 355/260 |
| 0103072 | 4/1990 | Japan | 355/260 |
| 0115875 | 4/1990 | Japan | 355/260 |

*Primary Examiner*—A. T. Grimley
*Assistant Examiner*—Matthew S. Smith
*Attorney, Agent, or Firm*—Tallam I. Nguti

[57] ABSTRACT

An electrostatographic development apparatus having a multi-section assembled housing includes a mechanism for sealing, and making section joints therein non-leaking. The sealing mechanism includes a piece of material that has a strong affinity or a strong binding attraction for toner particles that are handled in the housing, and that could leak through voids in such joints.

12 Claims, 1 Drawing Sheet

SEALING MECHANISM FOR TONER HANDLING APPARATUS

BACKGROUND OF THE INVENTION

The present invention relates to electrostatographic development apparatus, and more particularly, to a mechanism in such a development apparatus for sealing and making section joints in such apparatus non-leaking.

BACKGROUND ART

Development apparatus are well known for use in electrostatographic copiers or printers for developing latent charge images. As disclosed, for example, in U.S. Pat. No. 4,797,704, issued to Williams et al. on Jan. 10, 1989, such a development apparatus includes (a) development means for applying developer material to the latent images, (b) a sump portion having mixing means for holding and mixing the developer material, (c) feed means for feeding developer material from the sump portion to the development means, and (d) a housing which defines the sump portion and contains the other components of the apparatus. For precision and ease of manufacturing, it is often common to form the housing in multiple sections, including, for example, a cover. The various sections are then assembled by jointing together such that the assembled apparatus, as a whole, is ready for mounting in a copier or printer.

The developer material which, as discussed above, is held, mixed, and moved within the assembled housing of the apparatus usually consists of dry toner particles only, or of an admixture of carrier particles and such toner particles. In the latter case, the carrier particles, on the one hand, can be soft magnetic iron particles having a size of about 150 microns or less, or hard magnetic material particles having a size, for example, within the range 15–30 microns. On the other hand, the dry toner particles consist of carbon, or a pigment, dispersed in a thermoplastic resin, and then ground to approximately 5 to 15 microns in size.

Consequently, holding, mixing and moving developer material consisting of such fine and dry particles in a multi-section assembled development apparatus housing understandably will present leakage and contamination problems. There therefore has been a need to make section joints in development apparatus housing non-leaking with respect, particularly, to the much smaller 5 to 15 micron size toner particles.

Conventionally, it has been common to use ordinary mechanical or adhesive gaskets or seals for sealing such section joints. Adhesive seals, for example, tend to stick to anything and are, therefore, extremely difficult to assemble within such joints. Such difficult assembly usually results in undesirable voids within the joint through which toner particles can leak. In addition, adhesive seals, like other ordinary mechanical seals, also tend to age, and dry out, thereby again creating undesirable voids within the joint.

Furthermore, within an electrostatographic copier or printer, similar sealing difficulties and resulting leaking problems can also be experienced with respect to other toner particle handling components thereof, such as a cleaning apparatus.

SUMMARY OF THE INVENTION

It is an object of the present invention to provide a mechanism for creating a non-leaking joint between assembled sections of the housing of a toner handling apparatus.

It is also an object of the present invention to provide a mechanism for creating a non-leaking joint between assembled sections of a development apparatus housing.

It is also an object of the present invention to provide such a mechanism, including a gasket, which is easy to assemble within such joints.

It is another object of the present invention to provide such a mechanism, including a gasket, which relative to the life of the development apparatus, does not deteriorate significantly with age.

In accordance with the present invention, a mechanism is provided for creating a non-leaking joint between assembled sections of the housing of an apparatus which handles developer material that includes toner particles. The sealing mechanism comprises fastening means for fastening together a first section and a second section of the housing of such a handling apparatus, thereby forming a joint. The sealing mechanism also comprises a piece of material which is positioned in the joint for fastening, and which has a high affinity or strong binding attraction for the toner particles within the handling apparatus, so as to cause toner particles, initially leaking from within the handling apparatus housing through any voids in the formed joint, to become strongly bound or adhered to the toner-affinity piece of material therein, thereby sealing the voids and effectively making the joint non-leaking.

BRIEF DESCRIPTION OF THE DRAWINGS

In the detailed description of the invention presented below, reference is made to the accompanying drawings, in which.

DETAILED DESCRIPTION OF THE INVENTION

Figure 1:
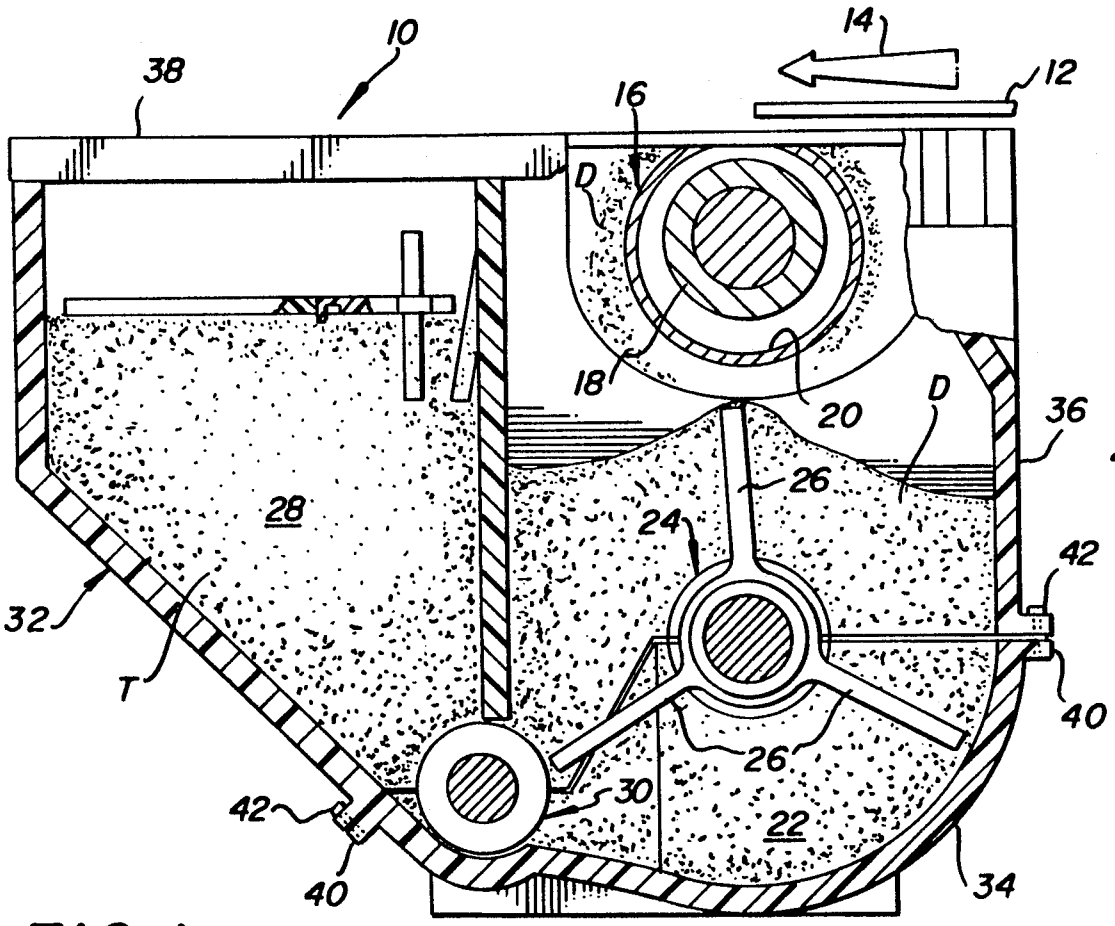
FIG. 1 is a schematic, partly in section, of a multi-section housing electrostatographic development apparatus including the mechanism of the present invention.

Referring now to FIG. 1, a toner handling apparatus such as an electrostatographic development apparatus of the present invention is generally designated 10. The development apparatus 10, as is well known, can be used in a copier or printer to develop latent charge images formed electrostatically on an image-bearing member 12, being moved, for example, in the direction of the arrow 14. As illustrated, the development apparatus i0 includes development means 16, such as a magnetic development roller, for moving developer material D into desired proximity with latent charge images on the member 12. The magnetic development roller 16 may consist, for example, of a magnetic core 18 surrounded by a rotatable non-magnetic shell 20. The developer material D, for example, is comprised of an admixture of dry magnetic carrier particles and dry marking or toner particles. The carrier particles can be 15 microns or greater in size, and the toner particles 15 microns or less in size.

In the development apparatus 10, a quantity of the developer material D is held and mixed in a sump portion 22 which has mixing means 24. Mixing means 24 includes feed means such as blade members 26 for feeding the developer material D from the sump portion 22 to the development means 16. Moving and mixing the developer material D, triboelectrically charges its carrier and toner particles to desired and opposite polarities. When fed by the blades 26 and means 16 into the desired proximity with the image-bearing member 12, the charged toner particles will be transferred to the latent charge images on such member 12. Such transfer of toner particles depletes the quantity of such particles in the developer material D. Therefore, to replenish the developer material D in the sump 22 with fresh toner particles T, the apparatus 10 further includes a replenishment toner chamber 28. A toner particle dispensing roller 30 is controlled to feed such fresh toner particles T from the holding chamber 28 into the sump 22.

As shown, the apparatus 10 also includes a housing shown generally as 32. For ease of manufacturing, for example, the housing 32 can be made in a plurality of wall sections including a first wall section 34, a second wall section 36, and a cover 38. As further shown, the first wall section 34 defines the sump portion 22, and the second wall section 36 partially defines the toner holding chamber 28, as well as contains the development means 16 and part of the feed means 26. The overall housing 32 is assembled by jointing the various wall sections together. For example, as assembled, the first and second wall sections 34, 36 form a joint indicated generally as 40.

In the present invention, the joint 40 must be effectively sealed in order to prevent the 15 micron or less toner particles, for example, from leaking therethrough and possibly causing undesirable contamination. The apparatus i0 therefore includes a mechanism indicated as 42 for sealing and making the joint 40 effectively non-leaking.

Figure 2:
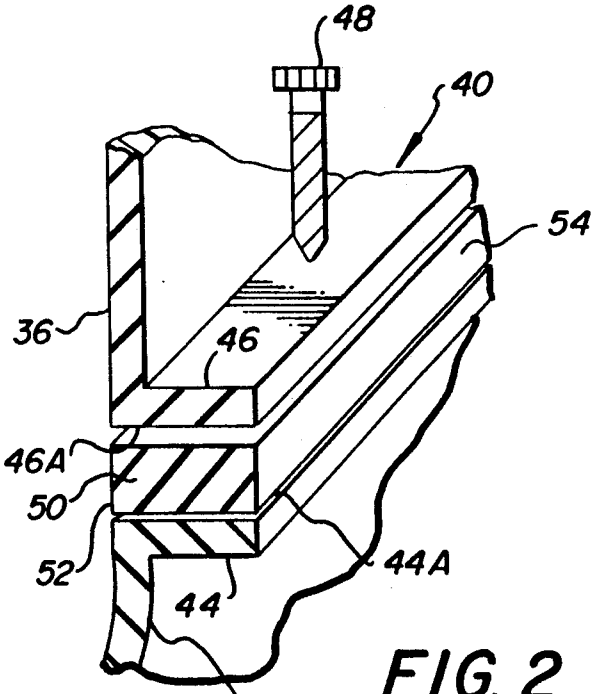
FIG. 2 is an enlarged illustration, partly in section, of a joint in the housing of the development apparatus of FIG. 1 including the mechanism of the present invention.

Referring now to FIG. 2, the mechanism 42 is illustrated within an enlarged portion of the joint 40 of housing 32. As shown, the first and second sections 34, 36 of the housing 32 may include flange portions 44, 46, respectively, which abut to form the joint 40. As shown, the mechanism 42 includes fastening means 48, such as a self-tapping screw, for fastening together the abutting flanges 44, 46 of first and second wall sections 34, 36. The mechanism 42 also includes a piece or strip of material 50 which is positioned in the joint 40, that is, positioned as shown in FIG. 2 between the ends of the walls and flange portions 34, 36 and 44, 46, respectively, for fastening therein.

Figure 3:
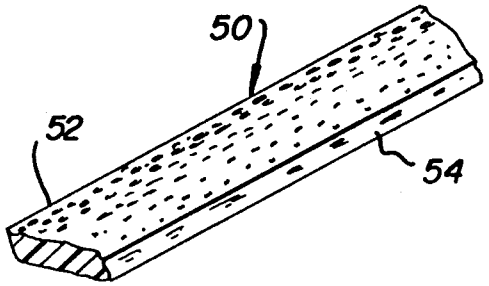
FIG. 3 is an illustration, partly in section, of the gasket device of the present invention showing toner particles strongly bound thereto.

Referring to FIGS. 2 and 3, the material 50 as selected is deformable, and is preferably in sheet form. It is ordinarily non-adhesive and so will not stick or tend to adhere to the walls or flange surfaces. Most importantly, the material 50 has an affinity for, or strong binding attraction to, the toner particles T contained in the developer material D being handled in the apparatus 10. Such affinity or attraction for the toner particles T will cause any such toner particles attempting to leak through any voids in the joint 40, as packed or gasketed with the material 50, to strongly bind or adhere to the toner-affinity material 50.

It has been found, for example, that the toner-affinity material 50 can be a plasticized polyvinyl resin or vinyl plastic. In particular, a flexible vinyl compound made by B. F. Goodrich under the trade name GEON compound #83332 has been found to be effective as the material 50. In the present invention, the sealing mechanism 42 further includes the leaking toner particles which have become bound, as such, to the material 50. Such binding, in effect, seals any voids in the fastened joint 40, and thereby effectively makes the joint 40 non-leaking thereafter.

It is further believed that the affinity or strong binding attraction between toner particles and the vinyl material is due primarily to a surface-to-surface adhesion between their surface molecules. As is well known, the toner particles when heated tend to flow much like a liquid. The binding attraction appears to occur because the surface molecules of the flowable toner particles have a greater attraction for the surface molecules of the solid vinyl material than for other toner molecules in the toner particle.

The ability of the surface molecules of a solid surface, such as the vinyl surface, to attract the surface molecules of a liquid, for example, as is known, can be characterized by reference to the "critical surface tension" of the solid surface. The critical surface tension of a solid surface, as such, is defined as the surface tension, or attractive force that will be exerted by such a solid surface upon the surface molecules of a liquid drop or flowable particle such that the liquid drop or particle is caused to spread on the solid surface with a zero degree contact angle. Critical surface tension is measured in milli Newtons per meter ($mNm^{-1}$).

Vinyl compounds such as GEON #83332 have been found to have critical surface tensions of about 40 $mNm^{-1}$ at 20° C. It is believed, therefore, that thermoplastic polymers, such as GEON #83332, which have a critical surface tension within the range of 30–50 $mNm^{-1}$ will exhibit the required affinity or strong binding attraction for toner particles, and therefore will be effective as the material 50 of the present invention.

In strip or sheet form, the piece of material 50 should have an appreciable thickness, as shown. Creating a non-leaking joint 40, as above, merely requires placing the strip or sheet of material 50 on the abutting surface 44A, for example, of the wall and flange portions of the first section 34 of apparatus 10. Next, the abutting surface 46A wall and second flange portions of the second section 36 thereof is placed over the strip or sheet of material 50. The material 50, as such, forms a gasket or packing within the joint 40. As packed, the inner edge 52 of the strip or sheet 50 will come into contact with developer material being mixed and moved within the apparatus 10, while the edge 54 thereof will be towards the outside of the apparatus.

To continue formation of a non-leaking joint 40, the flanges 44, 46, and strip of material 50 as illustrated in FIG. 2, are fastened together, for example, with the screw 48 thereby deforming the material 50 and forming a pressure-tight joint. As is well known, however, appreciable voids still will exist between the abutting surfaces 44A, 46A and the material 50. Such voids, for example, may be due to surface irregularities.

In the present invention, such voids are rendered tightly sealed by mixing and moving developer material containing the toner particles T inside the apparatus 10, against the fastened joint 40. This will bring the toner particles T against the inner edge 52, and will result in some of the toner particles T initially attempting to leak through any voids in the fastened joint, to strongly bind or adhere to the piece of gasket material 50, as described above. The binding or adherence of the toner particles, as such, effectively seal the voids thereby making the joint 40 non-leaking.

Although the invention has been described with specific reference to a development apparatus that handles multiple component development material, it will work equally in one that handles single component developer material. The sealing mechanism of the present invention will also work equally well in any other component, of an electrostatographic copier or printer, that handles toner particles. As such, it will work for creating non-leaking joints, for example, in a cleaning apparatus.

The invention has been described in detail with particular reference to a presently preferred embodiment, but it will be understood that variations and modifications can be effected within the spirit and scope of the invention.

What is claimed is:

1. A method for creating a non-leaking joint between stationary abutting sections of an electrostatographic development apparatus holding and moving developer material including toner particles, the method comprising the steps of:

(a) placing a piece of material, having an affinity or a strong binding attraction for such toner particles, on the abutting surface of a first section of the development apparatus;

(b) placing the abutting surface of a second section of the development apparatus over said piece of material on said first section, said piece of toner-affinity material forming a packing between said first and said second sections of the development apparatus;

(c) fastening together said first and said second sections of the development apparatus creating a pressure-tight joint; and (d) tightly sealing any voids, in said joint, between said piece of toner-affinity material and said abutting surfaces by moving the toner particles in said apparatus against said joint so as to allow toner particles initially attempting to leak through such voids to tightly bind or adhere to said piece of toner-affinity material, thereby sealing such voids and effectively making said joint non-leaking.

2. A mechanism for creating a non-leaking joint between assembled sections of a housing of a toner particle handling apparatus, the mechanism comprising:

(a) fastening means for fastening together a first wall section and a second wall section of the housing of such a toner handling apparatus thereby forming a joint;

(b) a piece of thermoplastic material positioned in said joint for fastening therein, said piece of material having an affinity or a strong binding attraction for such toner particles; and (c) toner particles, leaking from within the handling apparatus housing through any voids in said joint, strongly binding or adhering to said piece of toner-affinity material therein, thereby sealing the voids and effectively making said joint non-leaking.

3. The mechanism of claim 2 wherein said toner-affinity piece of material is a thermoplastic polymer having a critical surface tension within the range of 30–50 $mNm^{-1}$.

4. The mechanism of claim 3 wherein said thermoplastic polymer is GEON #83332 as made by B. F. Goodrich.

5. The mechanism of claim 2 wherein said piece of material is deformable.

6. The mechanism of claim 2 wherein said piece of material is in the form of a sheet.

7. A gasket for making a non-leaking joint between stationary abutting sections of an electrostatographic development apparatus holding and moving developer material including toner particles, the gasket consisting of a piece of material having an affinity or a strong binding attraction for such toner particles so as to cause any such toner particles, initially attempting to leak through any voids in the joint, to strongly bind or adhere to said piece of toner-affinity material, thereby sealing the voids and effectively making the joint non-leaking, said piece of material being a thermoplastic polymer.

8. The gasket of claim 7 wherein said piece of toner affinity material is made from a thermoplastic polymer having a critical surface tension of 30–50 $mNm^{-1}$.

9. A development apparatus for developing images in an electrostatographic copier or printer, the development apparatus including:

(a) development means for moving developer material, having toner particles, into a toner particle transferring relationship with latent images on an image-bearing member of such copier or printer;

(b) a sump portion, including mixing means, for holding a supply of the developer material;

(c) feed means for feeding the developer material from said sump portion to said development means;

(d) a housing having (i) a first wall section defining said sump portion, and (ii) at least a second wall section containing said development means and said feed means, said first and second wall sections of said housing forming a joint; and (e) a mechanism for sealing and making said joint non-leaking, said mechanism comprising:

(i) means for fastening together said first section and said second wall sections of the development apparatus forming a joint; and (ii) a piece of thermoplastic material positioned in said joint for fastening therein, said piece of material having an affinity or a strong binding attraction for such toner particles so as to cause any such toner particles, initially attempting to leak through any voids in said joint, to strongly bind or adhere to said piece of toner-affinity material, thereby sealing the voids and effectively making said joint non-leaking.

10. A mechanism for creating a non-leaking joint between assembled sections of the housing of a toner particle handling apparatus, the mechanism comprising:

(a) fastening means for fastening together a first wall section and a second wall section of the housing of such a toner handling apparatus thereby forming a joint; and (b) a piece of material positioned in said joint for fastening therein, said piece of material having an affinity or a strong binding attraction for such toner particles.

11. A development apparatus for developing images in an electrostatographic copier or printer, the development apparatus including:

(a) development means for moving developer material, having toner particles, into a toner particle transferring relationship with latent images on an image-bearing member of such copier or printer; and (b) a mechanism for sealing and making said joint non-leaking, said mechanism comprising:

(i) means for fastening together said first section and said second sections of the development apparatus forming a joint; and (ii) a piece of material positioned in said joint for fastening therein, said piece of material having an affinity or a strong binding attraction for such toner particles so as to cause any such toner particles, initially attempting to leak through any voids in said joint, to strongly bind or adhere to said piece of toner-affinity material, thereby sealing the voids and effectively making said joint non-leaking.

12. A mechanism for creating a non-leaking joint between assembled sections of the housing of an electrostatographic development apparatus holding and moving developer material including toner particles, the mechanism comprising:

(a) fastening means for fastening together a first wall section and a second wall section of the housing of such development apparatus thereby forming a joint;

(b) a piece of material positioned in said joint for fastening therein, said piece of material having an affinity or a strong binding attraction for such toner particles; and (c) toner particles, leaking from within the development apparatus housing through any voids in said joint, strongly binding or adhering to said piece of toner-affinity material therein, thereby sealing the voids and effectively making said joint non-leaking.

* * * * *